United States Patent [19]

Pfeifer et al.

[11] 4,315,399

[45] Feb. 16, 1982

[54] PROCEDURE FOR CLEANING A ROTOR OF A SPINNING UNIT OF THE OPEN-END TYPE

[75] Inventors: Hermann Pfeifer, Moillesulaz; Erwin Zurcher, Le Lignon, both of Switzerland

[73] Assignee: Officine Savio S.p.A., Udine, Italy

[21] Appl. No.: 136,247

[22] Filed: Apr. 1, 1980

[30] Foreign Application Priority Data

Apr. 2, 1979 [CH] Switzerland ..... 3040/79

[51] Int. Cl.[3] ..... D01H 11/00

[52] U.S. Cl. ..... 57/302

[58] Field of Search ..... 57/300, 301, 302

[56] References Cited

U.S. PATENT DOCUMENTS

| | | | |
|---|---|---|---|
| 3,524,312 | 8/1970 | Landwehrkamp et al. | 57/302 |
| 3,597,911 | 8/1971 | Schiltknecht | 57/302 |
| 3,662,532 | 5/1972 | Stahlecker | 57/80 X |
| 4,125,991 | 11/1978 | Stahlecker | 57/302 |

FOREIGN PATENT DOCUMENTS

| | | |
|---|---|---|
| 2130738 | 12/1972 | Fed. Rep. of Germany . |
| 2629161 | 1/1978 | Fed. Rep. of Germany . |
| 1004822 | 4/1952 | France . |
| 462620 | 5/1975 | U.S.S.R. . |

*Primary Examiner*—Donald Watkins

*Attorney, Agent, or Firm*—Stevens, Davis, Miller & Mosher

[57] ABSTRACT

A cleaning procedure consisting in imparting some ultrasonic vibrations of which the frequency is a harmonic of the natural frequency to at least one mode of vibration of a groove (1*b*) for union of fibres in a rotor (1) of a spinning unit, and in applying to the rotor a transducer (3) fed with current of an ultrasonic frequency by a generator (4) in such a way as to impart to the wall of the groove an energy capable of detaching the impurities lodged there so that the latter can be discharged with the help of a suction head (5) connected to a fan (6).

This procedure can be employed especially at the time when the yarn is pieced-up on a spinning machine of the open-end type.

2 Claims, 1 Drawing Figure

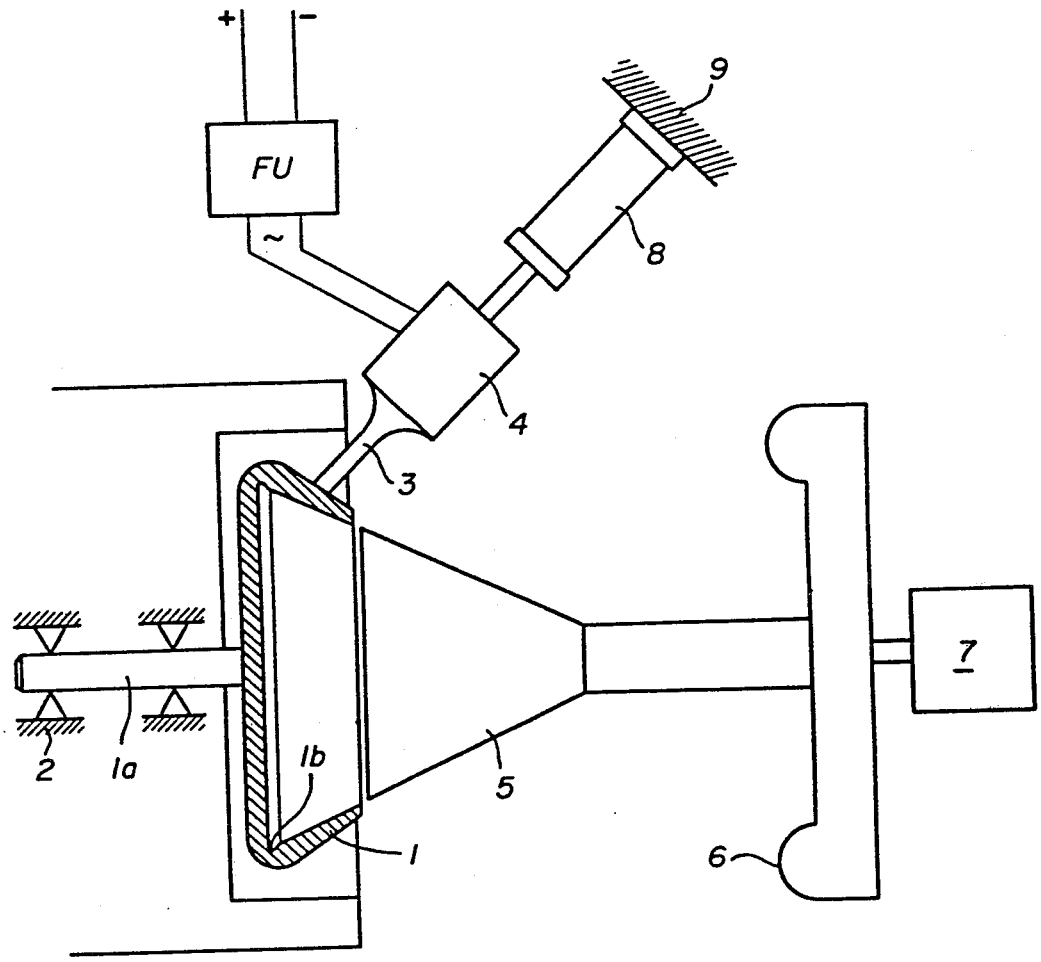
+
−
FU
~
9
8
4
3
7
2
1a
1b
5
1
6

PROCEDURE FOR CLEANING A ROTOR OF A SPINNING UNIT OF THE OPEN-END TYPE

The invention relates to a process for cleaning a rotor of a spinning unit of the open-end type.

In spinning machines of the open-end type the yarn is obtained by uniting an open ring of fibres in the groove of a rotor in the form of a bell, whereby one end of this ring of fibres is connected to the end of the yarn being produced, around which the fibres twist themselves gradually as the yarn is extracted from the rotor.

Since a certain quantity of impurities builds up in the groove for the union of the fibres, the quality of the yarn becomes worse and it ends by breaking.

The restarting of the spinning operation, which is also called the piecing-up of the yarn since it consists in bringing back the end of the yarn into the rotor at the same time as some fibres feed the groove of the rotor, can only be obtained on condition that the rotor and, in particular, the groove for the union of the fibres has been cleaned beforehand.

Given the very high speed of rotation of the rotors, the centrifugal force thrusts the impurities strongly into the bottom of the groove in such a way that they cannot be detached readily.

A large number of solutions has already been put forward for cleaning the rotor of the spinning turbine.

Proposals have been made for some pneumatic means, jets of compressed air and withdrawal by suction, and for mechanical means in the form of flexible scrapers, with or without a brush, intended to be inserted into the groove for union of the fibres in the rotor, after which the impurities can be withdrawn by suction.

Some means exist for cleaning the rotor equally well with the turbine open or closed.

In every case the cleaning means have to be brought into the groove for union of the fibres in the rotor, but access to this groove is not always easy. Moreover, to ensure cleaning over the whole surface forming the groove, the rotor should turn meanwhile and its speed should be low enough for the centrifugal force not to cause the impurities which have previously been detached from the groove for the union of the fibres to adhere once more thereto.

Cleaning with compressed air requires the connection of the cleaning device to a source of compressed air and the delivery of the air to the immediate neighbourhood of the groove which involves a nozzle, some means to guide the nozzle, some displacement means and a flexible or telescopic feed pipe.

Mechanical cleaning with the aid of a brush involves the problem of periodic cleaning of the brush.

The purpose of this invention is to simplify at one and the same time the cleaning procedure and the means required for putting it into operation, and also to reduce as far as possible the time required for this operation, meanwhile ensuring an optimum cleaning efficiency.

For this purpose this invention has as its object a procedure for cleaning a rotor of an open-end spinning unit, characterised by the fact that to the rotor is imparted a vibration of an ultrasonic frequency corresponding to a harmonic of the natural frequency for at least one mode of vibration of a portion of the wall of the rotor delimiting the groove for union of the fibres in the rotor, in such a way as to impart to the surface of the groove an energy capable of detaching the particles of foreign matter lodged therein, whereby the particles detached from the rotor are also discharged.

A further object is a device for putting the procedure into operation, characterized by the fact that it comprises an ultrasonic generator, a transducer connected to the generator and some means to apply the transducer tightly against a portion of the surface of the rotor of the aforesaid unit.

Other details and features of the invention will stand out from the description given below by way of non-limitative example and with reference to the accompanying drawings, in which:

The FIGURE shows diagrammatically, a lay-out for the means used for putting the procedure into operation according to the present invention.

Referring to the drawing there is shown a rotor 1 of a spinning unit of a spinning machine of the open-end type.

The spindle of the rotor 1 is kept in a support 2.

A translator, currently called a "transducer" 3, connected to an ultrasonic generator 4 fed by a source of current with an ultrasonic frequency FU, is brought against the edge of the spinning rotor.

A suction head 5 positioned in the opening of the rotor 1 is connected to a fan 6 set in motion by a motor 7.

The ultrasonic generator 4 and the transducer 3 are fitted onto a supporting frame 9 by means of a jack 8.

During the ultrasonic transmission the transducer 3 should be in close contact with the rotor 1.

For this purpose the jack 8 or another suitable means serves to hold the rotor 1 against the transducer 3.

During spinning some fibres are brought into the rotor 1 and are united, owing to the effect of centrifugal force, in a circular groove **1*b*** of the rotor.

At this place too impurities build up, being mixed with the fibres.

The cleaning of the rotor consists essentially in removing the impurities from the groove **1*b*** and discharging them.

Th application of ultrasonic frequencies to the rotor 1 aims to remove the impurities from the groove **1*b*, their discharge thereafter being ensured by the suction head 5**.

The ultrasonic generator 4 should be turned to a harmonic frequency suitable for the mode of vibration of the rotor 1 at the surface of the groove **1*b* in such a way as to impart to this portion of the rotor 1** enough energy to dislodge the impurities.

This frequency can be determined empirically by varying progressively the frequency of the transducer 3 and by observing the behaviour of particles of any type of matter put into the groove **1*b*** so as to simulate the impurities which lodge there during the cleaning of the rotor.

As soon as the desired effect has been obtained, namely as soon as the particles have been detached from the groove and brought towards the centre of the rotor 1, the tuning of the transducer 3 is ensured for all identical rotors in such a way that it is enough to maintain the frequency.

Nevertheless, so as to take into account the manufacturing tolerances in one and the same series of rotors, it is also possible to envisage that a certain range of frequencies on each side of the proper middle frequency should be tested.

This tuning is done only once per given type of rotors, after which the cleaning device is ready to clean the rotors of one or more spinning machines comprising the same rotors.

The zone of transmission of ultrasonic frequencies to the rotor 1 and the transmission means employed are selected in such a way as not to damage the rotor.

It is also necessary to ensure a sufficiently rigid contact with the rotor 1 so as to obtain a good transmission of vibrations between the transducer 3 and the rotor 1.

When these conditions have been fulfilled and the tuning of the frequency is right, the cleaning operation can be carried out within a fraction of a second.

The zone where the vibrations are imparted to the rotor is, in practice, unimportant and it is only the frequency which determines the effect sought for.

Seeming that the choice of frequency makes it possible to act very locally, and mainly on the surface of the groove 1*b*, it is possible to lessen the effect of the ultrasonic frequencies on the other organs of the spinning machines so as to make this cleaning procedure compatible with the normal wear of the machine.

We claim:

1. A process for cleaning a rotor of an open-end spinning unit, comprising imparting a vibration of an ultrasonic frequency corresponding to a harmonic of the natural frequency to at least one mode of vibration of a portion of a wall of said rotor delimiting a groove for the union of fibres, to impart to the surface of said groove an energy capable of detaching the particles of foreign matter lodged there, and discharging these particles from the rotor.

2. Device for cleaning a rotor of an open-end spinning unit comprising an ultrasonic generator, a transducer connected to said generator, and means to apply said transducer tightly against a portion of the surface of the rotor of said unit.

* * * * *